United States Patent [19]

Bonello

[11] 4,106,238

[45] Aug. 15, 1978

[54] INTERCHANGEABLE STORM DOORS

[75] Inventor: Alfred Bonello, Islington, Canada

[73] Assignee: Indal Product Limited, Weston, Canada

[21] Appl. No.: 735,401

[22] Filed: Oct. 26, 1976

[51] Int. Cl.[2] ..... E05D 7/02

[52] U.S. Cl. ..... 49/382; 16/130; 49/399; 49/504

[58] Field of Search ..... 49/382, 399, 380, 504; 16/130, 132; 160/229

[56] References Cited

U.S. PATENT DOCUMENTS

| | | | |
|---|---|---|---|
| 2,818,145 | 12/1957 | Bragman et al. | 49/399 |
| 3,002,592 | 10/1961 | Quinn | 49/399 |
| 3,047,912 | 8/1962 | Sobolewski | 49/380 X |
| 3,774,345 | 11/1973 | Cole et al. | 49/504 |
| 3,978,619 | 9/1976 | Gregoire | 49/380 X |

*Primary Examiner*—Philip C. Kannan
*Attorney, Agent, or Firm*—Ivor M. Hughes

[57] ABSTRACT

A door assembly including a door having a top, bottom and side rails along each longitudinal edge of the door, at least one hinge to be secured to the door, and means, to the at least one hinge, to be secured to a door frame to mount the door, the side rails having channels running along a substantial length of the door opening at the top or bottom, of the door, the said channels being of a configuration to accommodate the at least one hinge, the at least one hinge having a hinge flange being adapted to be secured to, or removed from, the door only by sliding it from the top or bottom portion of the channel into position, and fastening means for securing the flange of the at least one hinge to the bottom of the channel upon being driven through said flange and the bottom of the channel into the door, when said flange is positioned in the channel.

9 Claims, 9 Drawing Figures

FIG. 2
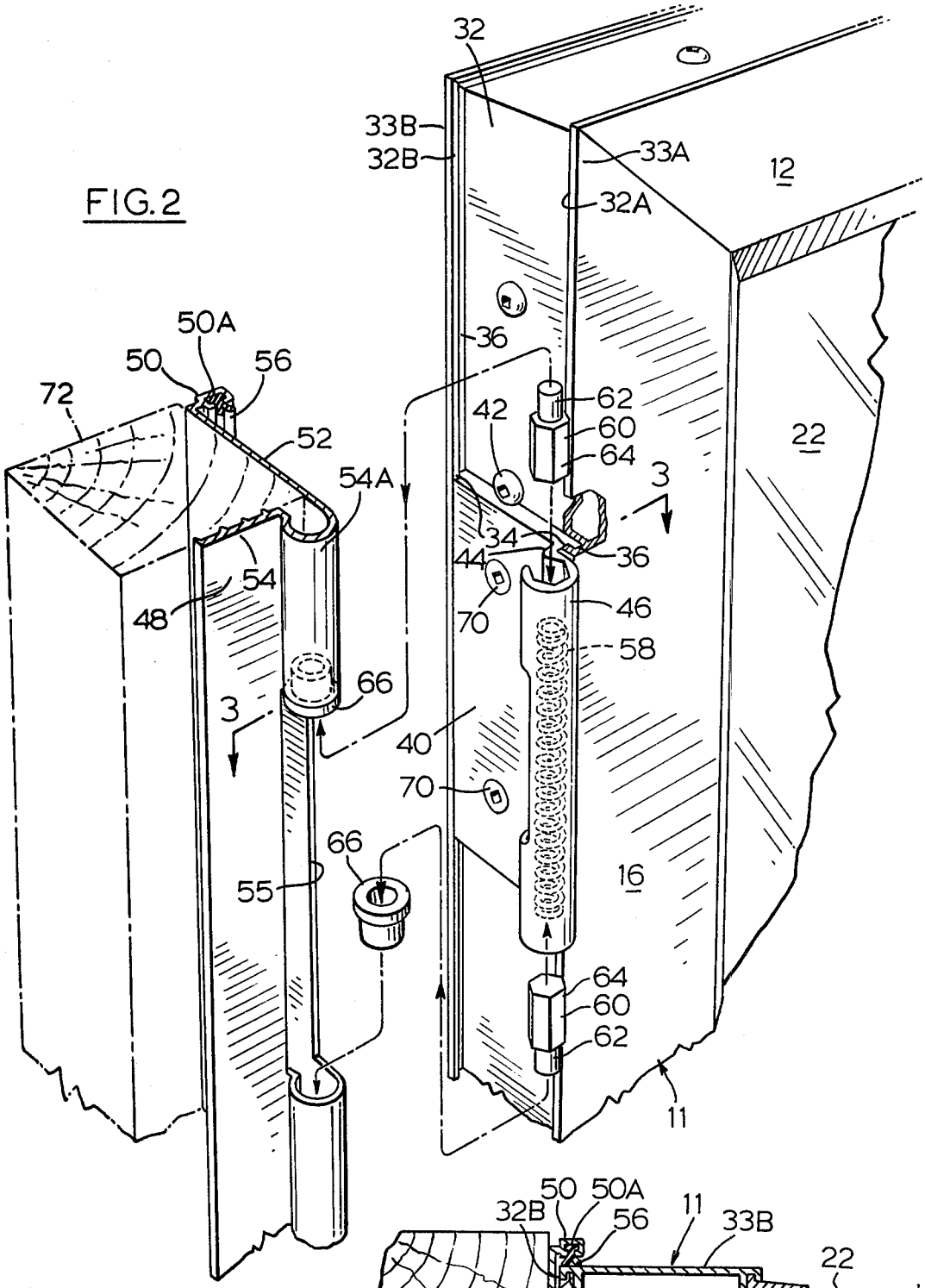
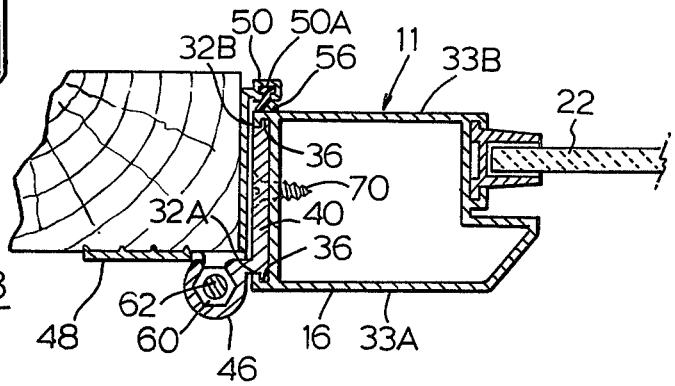
FIG. 3

INTERCHANGEABLE STORM DOORS

FIELD OF INVENTION

This invention relates to doors and particularly to premanufactured storm doors ready for installation at the consumer's home, from either the left or right side.

BACKGROUND OF THE INVENTION

Doors, and particularly storm doors, are presently mass produced for hanging from either their longitudinal right or left sides, but, not from either side. Therefore, the manufacturer of such doors must carry two inventories, one set of doors prehung from the left side and another set, prehung from the right side, in effect, duplicating the inventory. The effect of the duplicate inventories is obvious—increased costs which must be passed on to the ultimate consumer.

It is therefore, an object of this invention to provide a door which is capable of mass production, yet is interchangeably mountable at either its left or right longitudinal side, depending upon the needs of the consumer.

It is a further object of this invention to provide such a door at minimal cost.

Further and other objects will be realized by the following summary of the invention and detailed description of preferred embodiments thereof.

SUMMARY OF THE INVENTION

According to one aspect of the invention, a door assembly is provided, including a door having a top, bottom, and side rails along each longitudinal edge of the door, at least one hinge to be secured to the door, and means, secured to the at least one hinge, to be secured to a door frame to mount the door, the side rails having channels running along a substantial length of the door opening towards the top or bottom of the door, the at least one hinge, each having a hinge flange being adapted to be secured to, or removed from, the door by sliding it into position.

According to another aspect of the invention, a door assembly is provided, including a door, having a top, bottom, and side rails along each longitudinal edge of the door, at least one hinge to be secured to the door, and means, secured to the at least one hinge, to be secured to a door frame to mount the door, each side rail having a channel, of the same width and configuration as the other side rail, disposed along its length, opening at least towards the top or bottom of the door, each channel having a mouth along the length of the channel, opening in a direction away from the side rail, each channel having a portion greater in width further from the mouth of the channel, than a restricted portion closer to the mouth of the channel, each hinge having a hinge flange of the same width and configuration as the channels, so that the hinge can only be inserted into either channel, by inserting and sliding it from either the top or bottom of the channel, whereby the hinge flange is enclosed and secured in the channel until it is removed by sliding it down the length of the channel to either the top or bottom end.

According to another aspect of the invention, a door assembly is provided, including a door, having a top, bottom, and side rails along each longitudinal edge of the door, at least one hinge and means secured to the at least one hinge to be secured to a door frame to mount the door, each side rail having longitudinal channels running down the front and rear faces thereof, along a substantial length of the door, each channel opening at least towards either the top or bottom of the door, each hinge having a hinge flange, the hinge flange including at either side a leg portion having an inwardly directed projection directed towards the other leg portion, the space between the leg portions being sufficient to accommodate the thickness of the door and the space between the projections being less than the thickness of the door, whereby the hinge can only be secured to the door by positioning the projections into the channels on either side of the rail from either the top or bottom of the channels, and sliding the projections and thus the hinge to an appropriate position, thereby grasping the door until such hinge flange is slid along the channels and is removed from either the top or bottom of the channels.

According to another aspect of the invention, a door assembly is provided, including a door, having a top, bottom, and side rails along each longitudinal edge of the door, at least one hinge to be secured to the door and means, secured to the at least one hinge, to be secured to a door frame to mount the door, each side rail having a channel running along its length, each channel being defined by side walls forming a continuation of the plane of the front and rear faces of the door, extending away from the side rail of the door, each of said channels being of the same width and configuration and having an inwardly directed lip on the end of each channel side wall, remote the side rail, being directed towards the other side wall to form an undercut in the channel between the lip and the side rail, the at least one hinge each having a hinge flange of the same width and configuration of the channel, so that when the hinge flange slides into the channel from either the top or bottom end of the channel, each side of the hinge flange lies in the undercuts formed in the channel.

BRIEF DESCRIPTION OF THE DRAWINGS

The invention will now be illustrated with reference to the following drawings, illustrating embodiments of the invention, in which:

FIG. 2 is a partially exploded close-up view of the upper left hand corner of the door of FIG. 1, secured to part of a door frame;

FIG. 3 is a cross-section, taken along the line 3—3 of FIG. 2;

DESCRIPTION OF PREFERRED EMBODIMENTS

Figure 1:
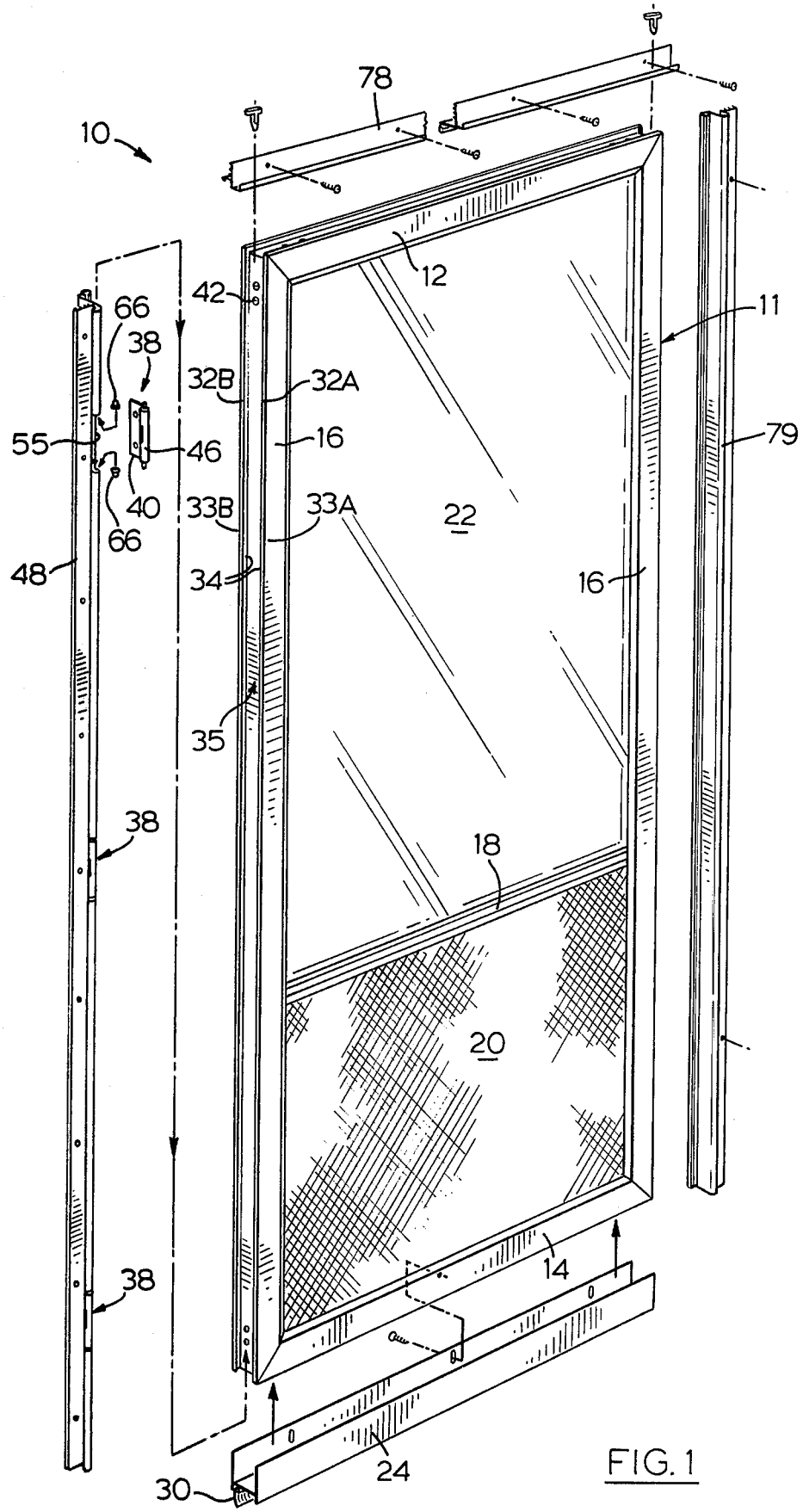
FIG. 1 is a perspective partially exploded view of a door, embodying a preferred embodiment of the invention.
Figure 4:
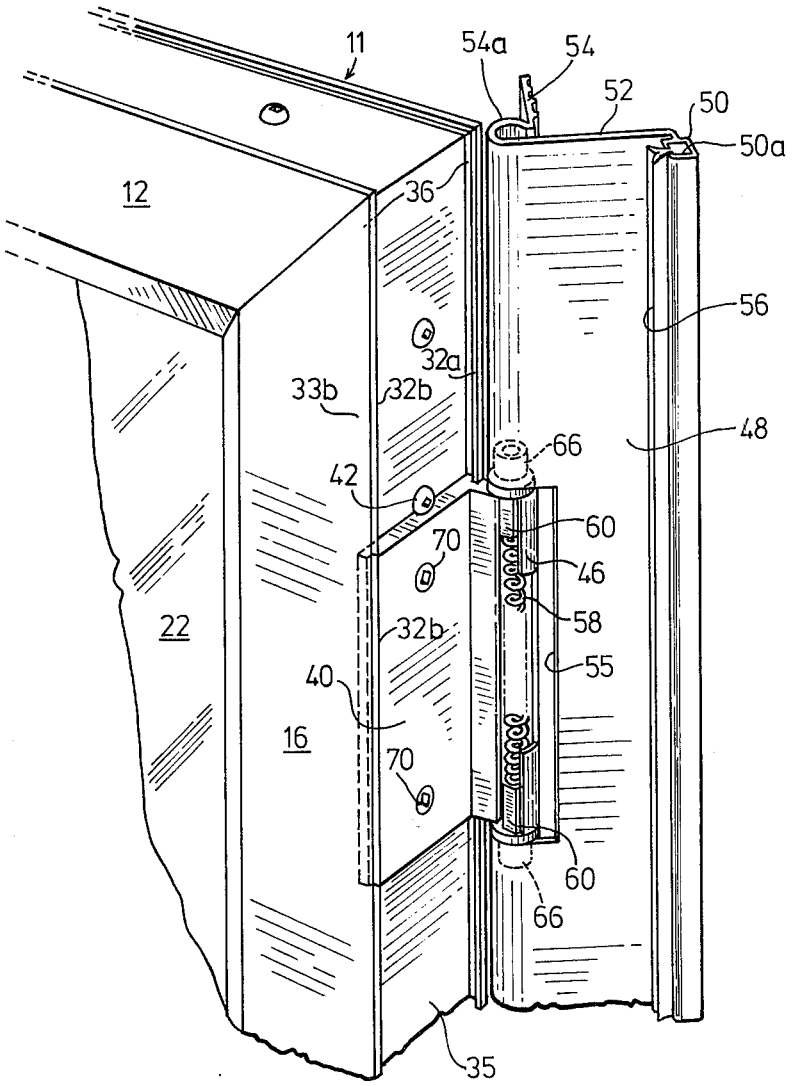
FIG. 4 is a perspective view looking from the rear of the embodiment shown in FIG. 1, in assembled state.

With reference primarily to FIG. 1, but also to FIGS. 2, 3 and 4, there is shown a storm door assembly 10, including a storm door 11, comprising a header frame 12, sill frame 14, main side rail frames 16, mullion 18, kick plate 20, glass insert 22, box sweep 24, secured by screws, as for example, screw 26 through slots 28, in box sweep 24 to the sill frame 14 at an appropriate height above the threshold of the door opening (not shown), to permit rubber sweep 30 to engage and seal the threshold, to seal the air space between the main door (not shown), and the storm door 10, under box sweep 24, out of communication with the outside environment. Each of main frame side rails 16, has like channels 32 (only one of which is shown) extending longitudinally along each side of the door, opening at the top and bottom, thereby permitting access into the channel, from the top and bottom of the door.

Each of channels 32 is defined by side walls 32A and 32B formed by the extension of the front face 33A and rear face 33B of side rails 16, away from the other side rail. Adjacent the mouth 35, running the length of channel 32 and secured to each side wall 32A and 32B are lips 34 extending inwardly, seen best in FIGS. 2, 3 and 4, providing undercuts 36 in channel 32 seen best in FIGS. 2, 3 and 4. Each of channels 32 as previously indicated is open at the top and bottom of the door, to permit the sliding thereinto of at least one hinge 38, only one of which is shown and each hinge is of such width and configuration (i.e. greater in width than mouth 35, but less than or equal to the width of channel 32, including the undercut portions 36) so that it cannot be placed into channel 32, but must be inserted as shown in FIG. 1, by sliding it from the bottom of the door 10, until it engages bolt 42, raised from the channel bed to act as a stop for hinge 38.

Secured to flange 40 is angled leg portion 44, in turn secured to circular portion 46 to correspond to the shape of a bar rail 48, for the purposes of securing the hinge to bar rail 48, bar rail 48 being known in the industry as a Z-Bar Rail, because it generally has the shape of a "Z" having a modified flange portion 50, web portion 52, and modified flange portion 54. Modified flange portion 50 includes a groove 50A in which a flexible sealing rubber material 56 is secured, to engage the rear face of main frame side rail 16 for sealing engagement therewith. Modified flange portion 54 includes a curved portion 54A for the purposes of securing the hinge 38 to Z-Bar Rail 48.

Hinge 38 includes a spring 58 disposed in curves portion 46, to urge pins 60 disposed at either end, and having projections 62 and central portion 64 of the same shape as the opening in portion 46, longitudinally outwardly of portion 46. Hinge 38 is secured to Z-Bar Rail 48 by pins 60, secured in oil-impregnated bearings 66, inserted into the correspondingly shaped curved portion 54A of Z-Bar Rail 48 in slot 55, (best shown in FIGS. 2 and 4).

To assemble, the side of the door to be hung is selected, the handle (not shown) secured if not previously done, in any manner known to a man skilled in the art, and the pre-assembled Z-Bar Rail 48 and hinge 38 are so positioned to permit hinge flange 40 to be slid into channel 32, to abut stop 42 and then self-tapping screws 70 are used to secure hinge 38 to the door in position as shown. The door is then hung (shown in cross-section in FIG. 2), by securing the Z-Bar Rail 48 to part of the frame of a house shown as 72 and the usual accompaniment to the door, for example, springs and an air cylinder are added. The Z-Bar Header 78 is then secured to the upper part of the frame to seal off the top and a plain Z-Bar Rail 79 is secured to the frame on the other side to seal the other side of the door.

With reference to FIGS. 5, 6, 7, 8 and 9, there is shown portions of hinges, secured in channels according to other embodiments of the invention, having different cross-sections to fit into channels of corresponding cross-sections. In these embodiments, only the shape and disposition of the hinge and channel are indentified, all other components of the door assembly being same as shown in the embodiment described in FIGS. 1 to 4 inclusive.

Figure 5:
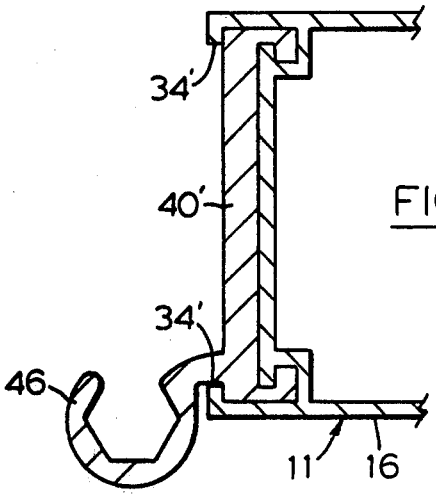
FIGS. 5, 6, 7, 8 and 9 are cross-sections taken through hinges and channels of side rails of doors according to other embodiments of the invention.
Figure 6:
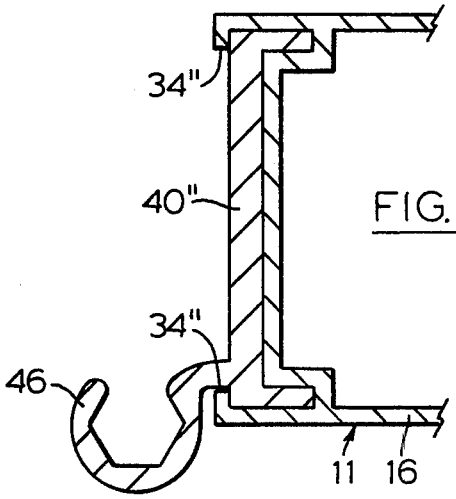
Figure 7:
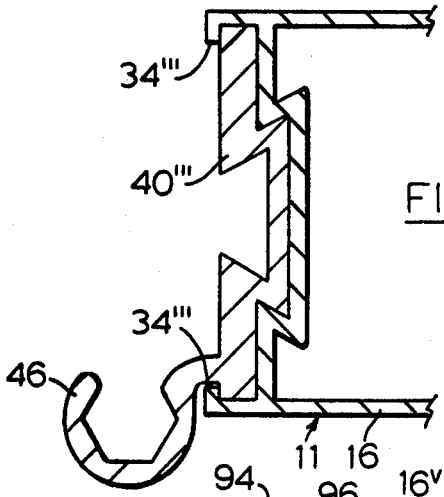

The embodiments shown in FIGS. 5, 6 and 7 include lips $34^{I}$, $34^{II}$, and $34^{III}$, respectively to provide undercuts to secure the hinge flanges $40^{I}$, $40^{II}$, and $40^{III}$.

Figure 8:
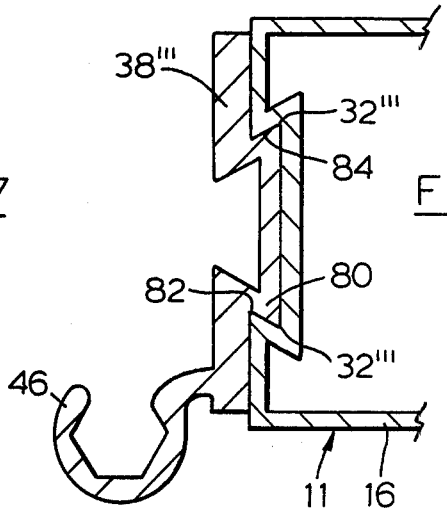

The embodiment shown in FIG. 8 illustrates the use of a channel $32^{IIII}$, having a portion 80 greater in width further from mouth 82 of channel $32^{IIII}$ than a restricted portion 84. Hinge $38^{IIII}$ is of corresponding width and configuration.

Therefore, it is apparent from FIGS. 5 through 8 inclusive, the hinge can only be secured in the channels by sliding the hinge flanges in from either end of the door, (either the top or bottom of the door).

Figure 9:
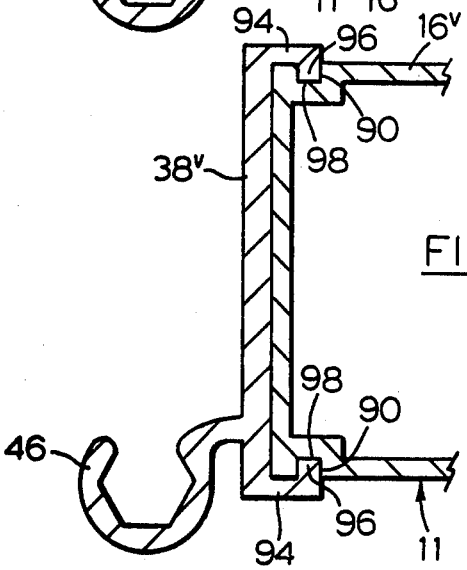

FIG. 9 provides still another embodiment of the invention, which includes channels 90 and 92 disposed in each of the side rails $16^{v}$, only one of which is shown. Hinge $38^{v}$ includes leg portions 94 having inwardly directed projections 96, having their edges 98 spaced by a distance less than the thickness of the side rail. Therefore, hinge $32^{v}$ can only be secured to side rail $16^{v}$, by positioning the hinge projections in alignment with the channels 90 at either end of the door and sliding the hinge along the length of the door to the appropriate position in effect grasping the side rail.

Therefore, while different embodiments have been shown, each hinge can only be mounted in its corresponding channel by sliding it into the channel from either end and removed by the reverse method with the result that the hinge and Z-Bar Rail Assembly can be secured to the door, on either side of the door, to permit the hanging of the door either from the left or right side.

As many changes could be made in the construction of the above preferred embodiments, it is intended that all matter contained herein be interpreted as illustrative of the invention, and not in a limiting sense.

The embodiments of the invention in which an exclusive property or privilege is claimed are as follows:

1. A door assembly including a door having a top, bottom and side rails along each longitudinal edge of the door, at least one hinge to be secured to the door, and means, secured to the at least one hinge, to be secured to a door frame to mount the door, the side rails having channels running along a substantial length of the door opening at the top or bottom, of the door, the said channels being of a configuration to accommodate the at least one hinge, the at least one hinge having a hinge flange being adapted to be secured to, or removed from, the door only by sliding it from the top or bottom portion of the channel into position, and fastening means for securing the flange of the at least one hinge to the bottom of the channel upon being driven through said flange and the bottom of the channel into the door, when said flange is positioned in the channel.

2. The door assembly of claim 1, wherein said means secured to the at least one hinge to be secured to a door frame to mount the door comprises a slotted Z-Bar Rail having a number of slots disposed along its length to accommodate the at least one hinge.

3. The door assembly of claim 1, wherein the channels on the side rails are formed by extensions of the plane of the front and rear faces of the door, away from the side rails to form side walls and each side wall includes an inwardly directed lip to define a mouth of the channel along the length of the channel opening in a direction away from the side rail and of lesser width than a channel portion between the mouth and side rail, and the at least one hinge is of the same width and configuration as the channel.

4. The door assembly of claim 1, wherein each of the side rails have longitudinal channels in each of the front and rear faces of the side rail equidistant from the longitudinal side edge of the side rail and the at least one hinge flange has spaced inwardly directed projections to slide within the channels when inserted from either the top or bottom ends of the channels to permit the hinge flange and thus the hinge to be appropriately positioned.

5. A door assembly including a door having a top, bottom and side rails along each longitudinal edge of the door, at least one hinge to be secured to the door, and means, secured to the at least one hinge, to be secured to a door frame to mount the door, each side rail having a channel, of the same width and configuration as the other side rail, disposed along its length, opening at least at the top or bottom of the door, each channel having a mouth along the length of the channel opening in a direction away from the side rail, each channel having a portion greater in width further from the mouth of the channel, than a restricted portion closer to the mouth of the channel, said at least one hinge having a hinge flange of the same width and configuration as the channels, so that the hinge can only be inserted into either channel, by inserting and sliding it from either the top or bottom of the channel, and fastening means for securing the at least one hinge flange upon being driven through the at least one flange and the bottom of the channel into the door, whereby the at least one hinge flange will be enclosed and secured in the channel until the at least one hinge is removed by removing the fastening means and sliding the at least one hinge flange down the length of the channel to either the top or bottom end.

6. The door assembly of claim 5 wherein said means secured to the at least one hinge to be secured to a door frame to mount the door comprises a slotted Z-Bar Rail having a number of slots disposed along its length to accommodate the at least one hinge.

7. A door assembly including a door, having a top, bottom and side rails along each longitudinal edge of the door, at least one hinge and means secured to the at least one hinge to be secured to a door frame to mount the door, each side rail having longitudinal channels running down the front and rear faces thereof, along a substantial length of the door, each channel opening at least towards either the top or bottom of the door, the at least one hinge having a hinge flange, the hinge flange including at either side a leg portion having an inwardly directed projection, directed towards the other leg portion, the space between the leg portions being sufficient to accommodate the thickness of the door, and the space between the projections being less than the thickness of the door, and fastening means to be driven through the at least one hinge flange through the bottom of the channel into the door, whereby the hinge can only be secured to the door by positioning the projections into the channels on either side of the rail from either the top or bottom of the channel and sliding the projections and thus the hinge to an appropriate position for securing by the fastening means to thereby grasp the door until such hinge flange is slid along the channel and removed from either the top or bottom of the channels.

8. The door assembly of claim 7 wherein each of said longitudinal channels running down the front and rear faces of each side rail, is spaced the same distance from the longitudinal outer edge of the side rail in which it is disposed.

9. A door assembly including a door, having a top, bottom, and side rails along each longitudinal edge of the door, at least one hinge to be secured to the door and means secured to the at least one hinge, to be secured to a door frame to mount the door, each side rail having a channel running along its length, each channel being defined by side walls forming a continuation of the plane of the front and rear faces of the door, extending away from the side rail of the door, each of said channels being of the same width and configuration and having an inwardly directed lip on the end of each channel side wall, remote the side rail, being directed towards the other side wall to form an undercut in the channel between the lip and the side rail, the at least one hinge having a hinge flange of the same width and configuration as the channel, and fastening means for being driven through the hinge through the bottom of the channel into the door, so that when the hinge flange slides into the channel from either the top or bottom end of the channel, each side of the hinge flange lies in the undercuts formed in the channel.

* * * * *